US006651834B2

(12) United States Patent
Wong

(10) Patent No.: US 6,651,834 B2
(45) Date of Patent: Nov. 25, 2003

(54) BOTTLE STOPPER WITH PRESSURE INDICATOR

(75) Inventor: Chung Lun Wong, Kowloon (CN)

(73) Assignee: Hometec Limited, Hong Kong (CN)

( * ) Notice: Subject to any disclaimer, the term of this patent is extended or adjusted under 35 U.S.C. 154(b) by 121 days.

(21) Appl. No.: 09/950,423

(22) Filed: Sep. 11, 2001

(65) Prior Publication Data

US 2003/0047531 A1 Mar. 13, 2003

(51) Int. Cl.[7] ..... B65D 51/16

(52) U.S. Cl. ..... 215/260; 215/364; 215/228; 215/262; 220/228; 116/266; 116/272

(58) Field of Search ..... 215/228, 260, 215/262, 270, 230, 296, 305, 364, 361, 307; 116/272, 266; 220/203.04, 203.07, 203.11, 203.13, 203.14, 203.19, 203.23, 212; 40/311; 141/65

(56) References Cited

U.S. PATENT DOCUMENTS

| | | | | |
|---|---|---|---|---|
| 3,926,329 A | * | 12/1975 | Guala | 215/361 |
| 4,524,877 A | * | 6/1985 | Saxby et al. | 215/228 |
| 4,558,795 A | | 12/1985 | Logue | |
| 4,723,670 A | * | 2/1988 | Robinson et al. | 215/228 |
| 4,763,803 A | | 8/1988 | Schneider | |
| 4,838,442 A | | 6/1989 | Merry | |
| 4,899,684 A | * | 2/1990 | Houzvic et al. | 116/272 |
| 5,031,785 A | | 7/1991 | Lemme | |
| 5,215,129 A | | 6/1993 | Berresford et al. | |
| 5,535,900 A | * | 7/1996 | Huang | 215/228 |
| 5,653,352 A | * | 8/1997 | Kim | 215/228 |
| 5,662,233 A | | 9/1997 | Reid | |
| 5,722,548 A | | 3/1998 | Hojnoski | |
| 5,975,322 A | | 11/1999 | Reid | |

FOREIGN PATENT DOCUMENTS

| | | | |
|---|---|---|---|
| FR | 2717152 | * | 9/1995 |

* cited by examiner

*Primary Examiner*—Robin A. Hylton
(74) *Attorney, Agent, or Firm*—Alix, Yale & Ristas, LLP

(57) ABSTRACT

A stopper for a bottle includes a resilient outer body having an axial bore, a rigid inner body disposed within the bore, and a valve actuator moveably disposed within an axial opening of the inner body. A lower flange portion of the outer body extends radially across the bore to an axial aperture having a sealing surface. The valve actuator has an upper operator portion connected to a lower valve body portion by a longitudinally extending shaft portion. The valve body portion is sealingly engageable with the sealing surface of the orifice to close the orifice. A vacuum in the bottle acts on a bottom biasing surface of the lower flange portion to bias the lower flange portion and the valve actuator downward into the bottle neck in opposition to a resilience force such that an indicator on the shaft portion proximate to the operator portion is withdrawn within the opening of the inner body when the vacuum is greater than a predetermined value and the indicator is visible above the inner body when the vacuum is less than the predetermined value.

13 Claims, 5 Drawing Sheets

BOTTLE STOPPER WITH PRESSURE INDICATOR

BACKGROUND OF THE INVENTION

This invention relates generally to stoppers which seal the opening of a container. More particularly, the present invention relates to bottle stoppers which seal the neck of a bottle and include means for drawing and maintaining a vacuum within the bottle.

Bottles are commonly used to store liquid beverages. The quality of many such liquids is subject to deterioration after the permanent bottle seal, required for transport and storage, is removed and only part of the contents are consumed. The liquid then comes into contact with the air after opening of the container. An example of such liquid is wine. Oxygen present in the air contacting unconsumed wine in a wine bottle will oxidize the wine, resulting in off-flavors in the unconsumed wine. Similarly, the quality of non-carbonated soft drinks may deteriorate upon exposure to air due to oxidation or other means. Many devices and systems have been proposed to reduce or eliminate such deterioration.

In one such system, nitrogen or other relatively heavy and inert gases are introduced into the opened bottle to displace the air and blanket the surface of the liquid. Such systems require a source of the gas and means for introducing the gas into the bottle. Such systems may also require means for retaining the gas within the bottle and in some cases means for venting the displaced air from the bottle. These systems are therefore relatively complex and require an assured gas source.

In other systems, a pump device is used to remove at least a substantial portion of the air from the bottle, thereby drawing a vacuum within the bottle. A stopper is installed in the neck of the bottle to maintain the vacuum and prevent the ingress of air. Such a system is disclosed in U.S. Pat. No. 4,763,803 and includes an integral stopper and valve assembly composed of an elastic material. The stopper shaft has an axial channel and the valve has an opening in the form of a slit which is located in the path of the channel. The valve can open outwards, allowing the slit to open, to permit the extraction of air from the container. The slit is held closed by the elastic properties of the material and/or by the pressure difference across the valve. Compressing ribs in the stopper opens the slit, allowing air to flow into the bottle and the stopper to be removed from the bottle for pouring. A pump comprising a cylinder, a piston disposed in the cylinder, and a mushroom valve is used to draw the vacuum in the bottle.

This system is relatively simple to use and inexpensive to manufacture. However, the seal formed between the edges of the valve slit is subject to several failure mechanisms. Such a slit is difficult to clean and may become fouled with liquid from the bottle, dust or the like. Repeated use of the stopper may result in degradation of the elastic properties which act to hold the slit closed. The pressure differential across the valve will ultimately lead to leakage during long-term storage of the unconsumed wine in the bottle. Should the seal fail and allow air to enter the bottle, such failure will remain undiscovered until an attempt is made to remove the stopper, allowing deterioration of the wine to progress undetected.

SUMMARY OF THE INVENTION

Briefly stated, the invention in a preferred form is a stopper for use in a bottle neck which includes as a novel feature not found in conventional stoppers a means for indicating the pressure within the bottle.

The stopper comprises a rigid valve actuator disposed in an outer body composed of a resilient material. The outer body includes a cylindrical sleeve portion and a lower flange portion which are inserted into the bottle neck, the outer surface of the sleeve portion forming an air-tight and fluid-tight seal with the bottle neck. The lower flange portion extends radially inward from the interior surface of the sleeve portion to an axial aperture having a sealing surface, partially closing the bore of the sleeve portion. The lower flange portion has a bottom biasing surface which is acted on by a vacuum in the bottle. The valve actuator includes an upper operator portion connected to a lower valve body portion by a longitudinally extending shaft portion. The valve body portion is sealingly engageable with the sealing surface of the orifice to close the orifice. The lower valve body portion and at least a part of the shaft portion are disposed within the bore of the outer body. The vacuum acts on the biasing surface of the lower flange portion to bias the lower flange portion and the valve actuator downward into the bottle neck in opposition to a resilience force of the lower flange portion such that an indicator on the shaft portion proximate to the operator portion is withdrawn within the bore of the outer body when the vacuum is greater than a predetermined value and the indicator is visible above the outer body when the vacuum is less than the predetermined value.

Another novel feature is the use of tapered, conical-shaped seating surfaces. The valve body portion of the valve actuator and the orifice in the lower flange portion of the outer body have complementary conical shapes, such that the seating surface of the orifice forms an airtight and fluid-tight seal with the valve body portion when the valve body portion is urged into the orifice. The tapered shape increases the frictional force between the seating surface and valve body portion, thereby providing improved resistance to air leakage into the bottle.

The outer body also includes an upper flange portion extending radially outward from the outer surface of the sleeve portion and having a lower edge which abuts a lip of the bottle neck when the stopper is installed. The upper flange portion of the outer body has an inner surface forming a circumferential groove.

The stopper also comprises a substantially rigid inner body including an upper flange portion having upper and lower segments. The lower segment is received in the circumferential groove of the upper flange portion of the outer body. The inner body also includes a longitudinally extending sleeve portion disposed intermediate the sleeve portion of the outer body and the shaft portion of the valve actuator. An axial opening extends longitudinally through the inner body. The diameter of the opening in the sleeve portion of the inner body is greater than the diameter of the opening in the upper flange portion of the inner body, such that the upper flange portion forms a downward facing shoulder.

A retainer segment on the shaft portion of the valve actuator disposed proximate to the valve body portion has an outside diameter which is greater than the diameter of the opening in the upper flange portion of the inner body. The length of the shaft portion of the valve actuator is selected to ensure that the valve body portion is fully withdrawn from orifice of the outer body before the retainer segment of the valve actuator engages the shoulder of the upper flange portion of the inner body. The outside diameter of the operator portion of the valve actuator is greater than the diameter of the opening in the upper flange portion of the inner body. The length of the shaft portion of the valve actuator is selected to ensure that valve body portion of the valve actuator is fully sealing engaged with the orifice of the outer body before the operator portion of the valve actuator engages the upper flange portion of the inner body.

A retainer segment on the shaft portion of the valve actuator disposed proximate to the valve body portion has an outside diameter which is greater than the diameter of the opening in the upper flange portion of the inner body. The length of the shaft portion of the valve actuator is selected to ensure that the valve body portion is fully withdrawn from orifice of the inner body before the retainer segment of the valve actuator engages the shoulder of the upper flange portion of the inner body. The outside diameter of the operator portion of the valve actuator is greater than the diameter of the opening in the upper flange portion of the inner body. The length of the shaft portion of the valve actuator is selected to ensure that valve body portion of the valve actuator is fully sealing engaged with the orifice of the outer body before the operator portion of the valve actuator engages the upper flange portion of the inner body.

The lower flange portion of the outer body protrudes upwardly into the opening of sleeve portion of the inner body when the valve body portion of the valve actuator is fully withdrawn from the orifice of the outer body. W hen the valve body portion of the valve actuator is fully sealing engaged with the orifice of the outer body, the valve body portion of the valve actuator biases the lower flange portion of the outer body downward out of the opening of the sleeve portion of the inner body.

It is an object of the invention to provide a new and improved stopper for use with a bottle.

It is also an object of the invention to provide a bottle stopper which provides a visual indication when a vacuum in the bottle is below a predetermined value.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
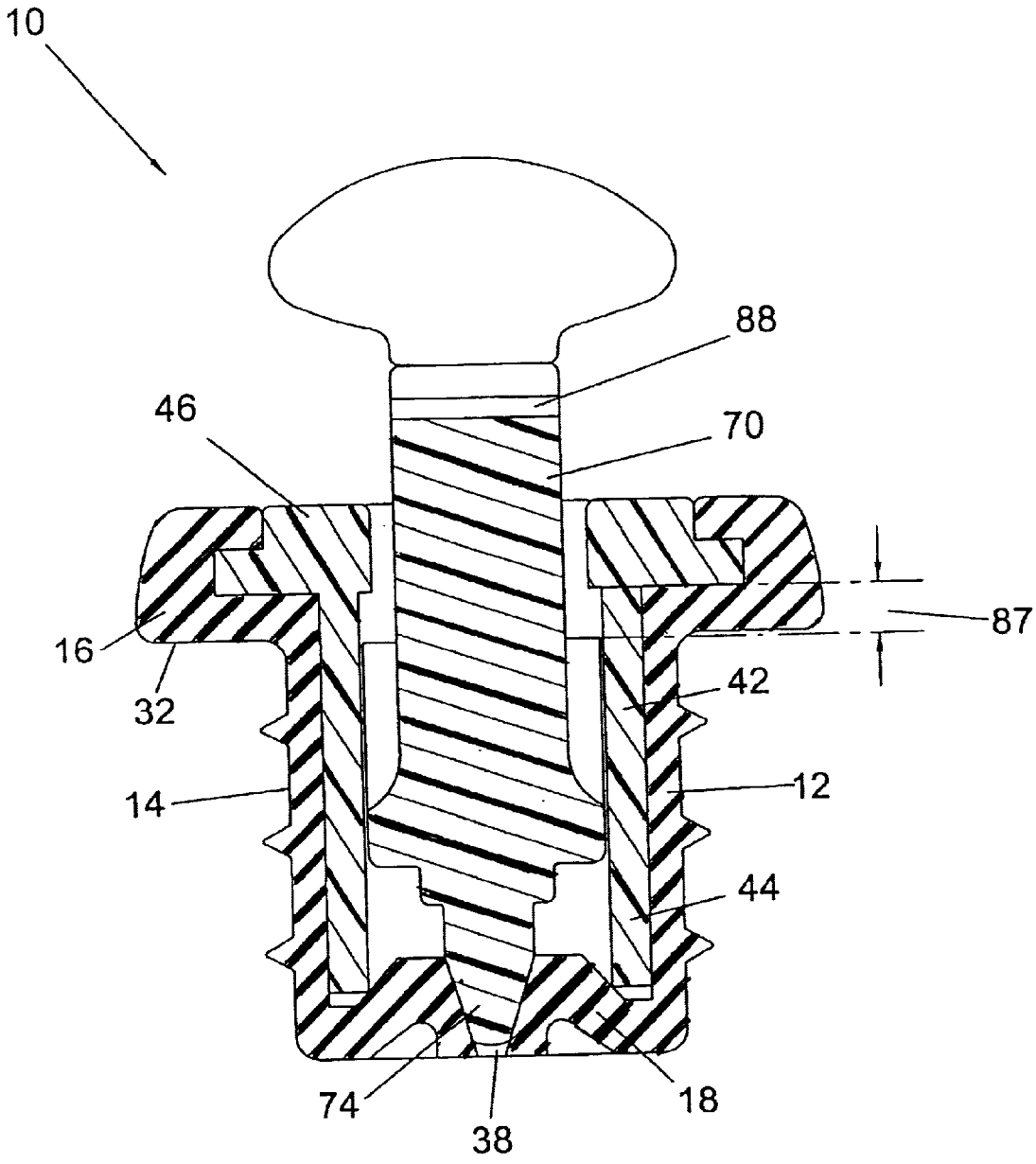
FIG. 1 is a cross-sectional view of a bottle stopper in accordance with the invention.
Figure 2:
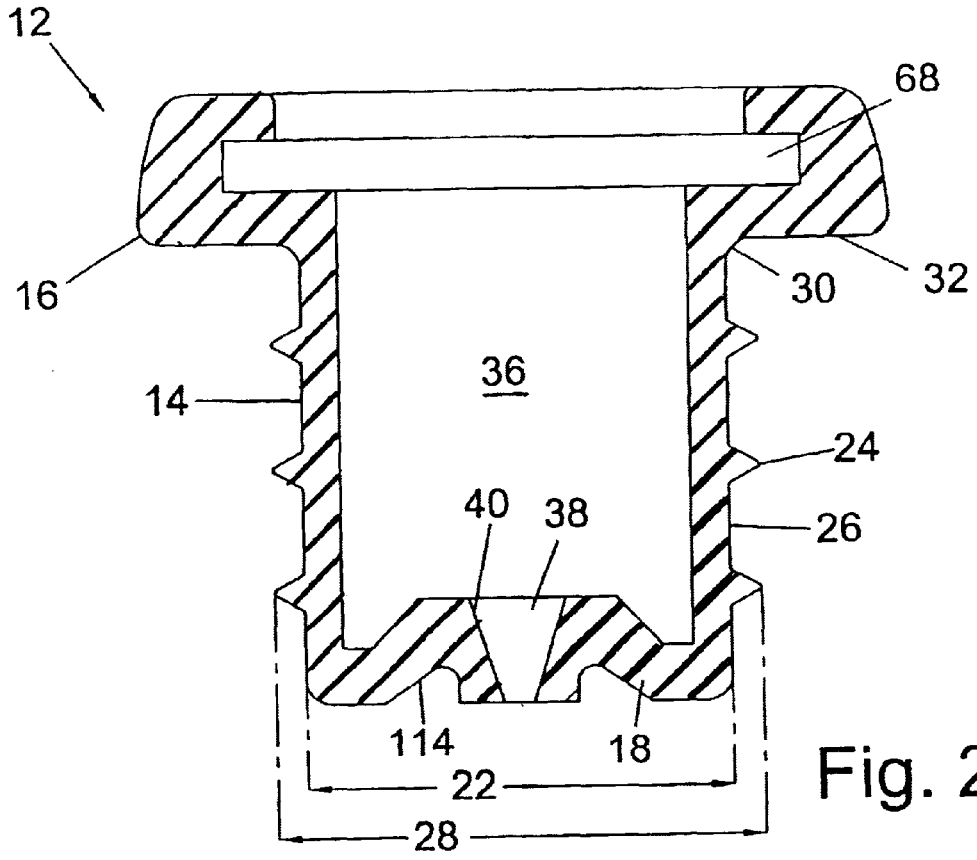
FIG. 2 is a cross-sectional view of the outer body of the bottle stopper of FIG. 1.
Figure 3:
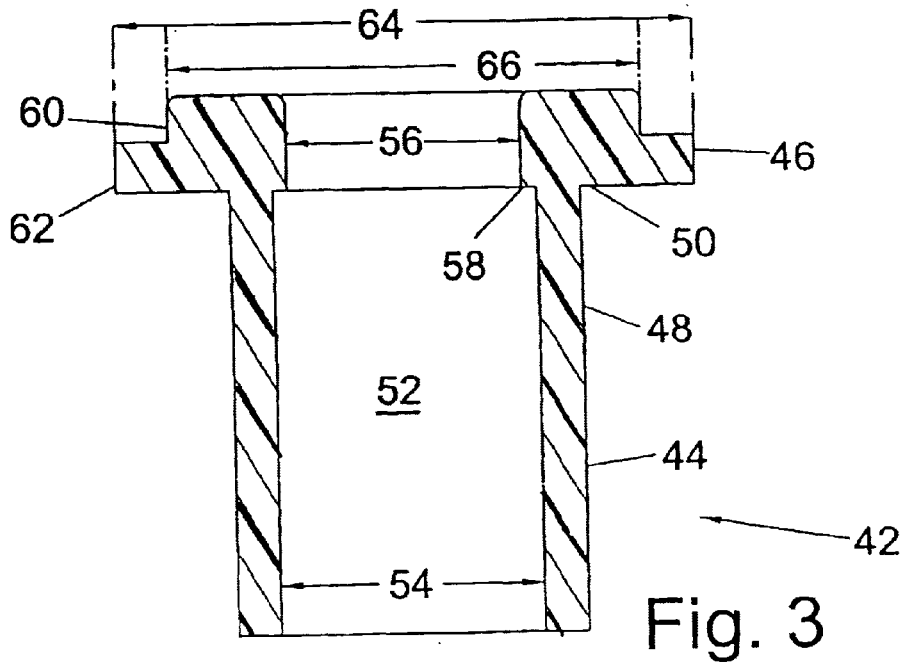
FIG. 3 is a cross-sectional view of the inner body of the bottle stopper of FIG. 1.
Figure 4:
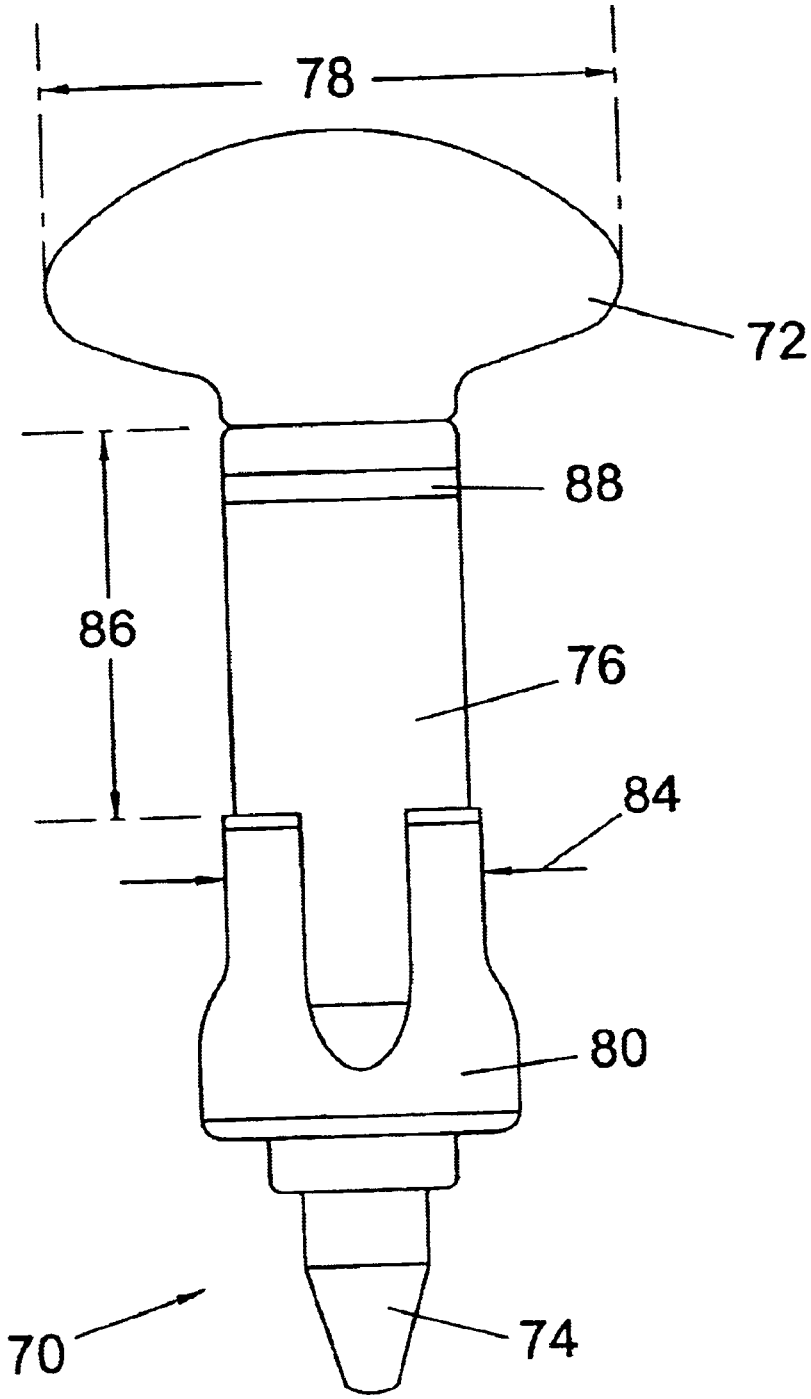
FIG. 4 is a side view of the valve actuator of the bottle stopper of FIG. 1.
Figure 5:
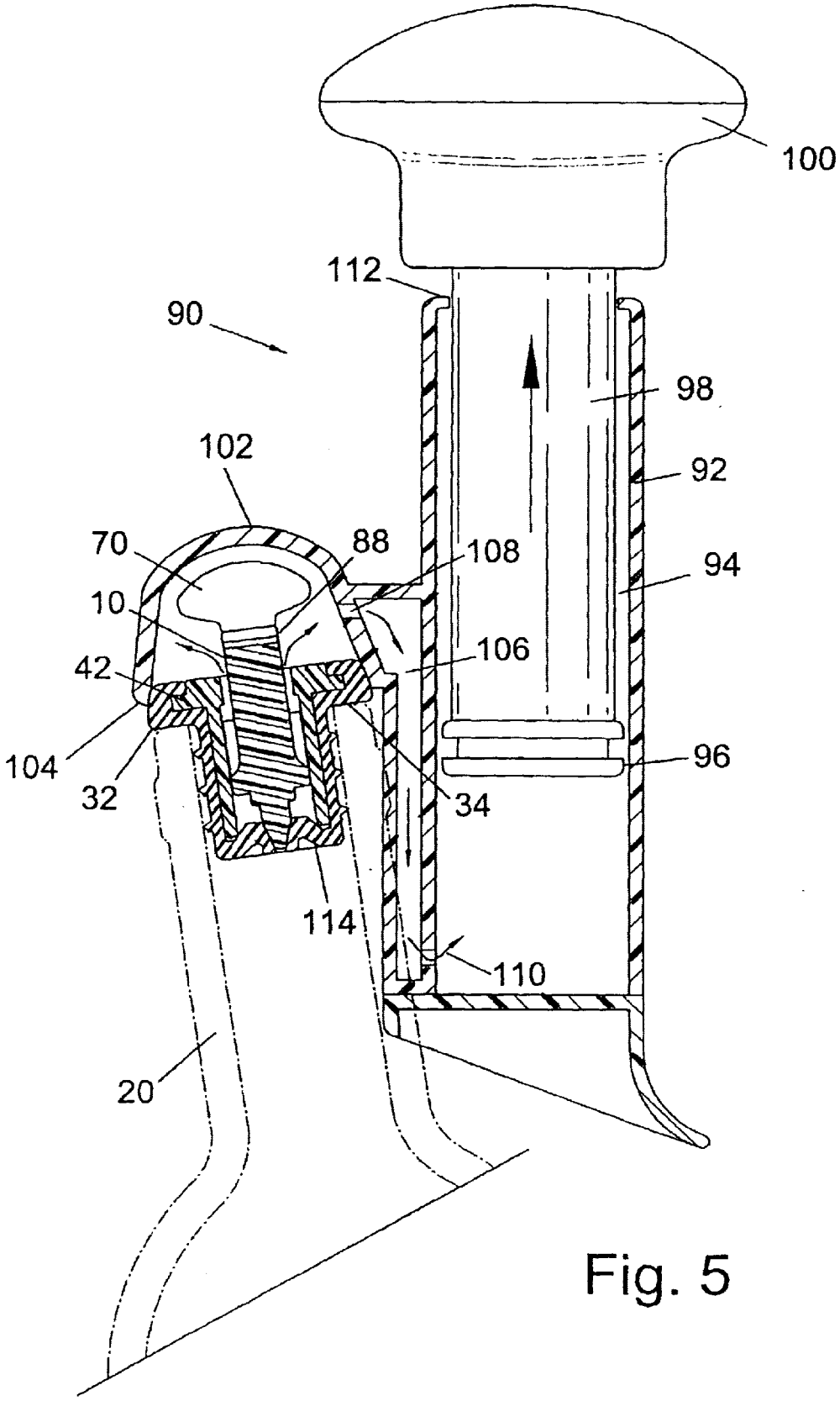
FIG. 5 is a cross-section view, partly broken away, illustrating the installation of the bottle stopper in a bottle using a pump device.
Figure 6:
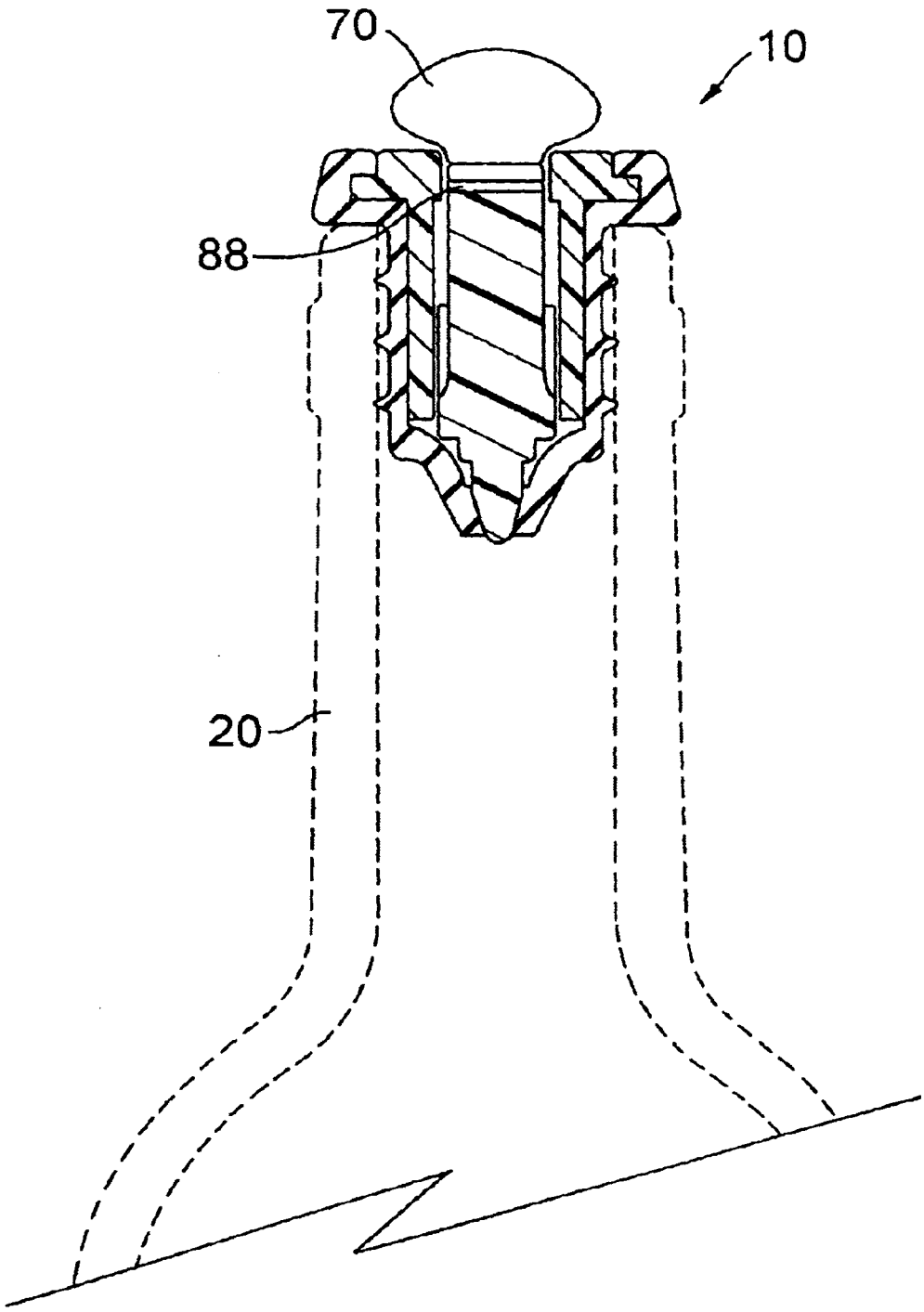
FIG. 6 is a cross-sectional view, partly broken away, illustrating the bottle stopper installed in a bottle.

With reference to the drawings wherein like numerals represent like parts throughout the several figures, a bottle stopper in accordance with the present invention is generally designated by the numeral 10.

The stopper 10 includes a one-piece, integral outer body 12 composed of a resilient material, for example silicon, having a longitudinally extending, cylindrical sleeve portion 14, an upper flange portion 16, and a lower flange portion 18. The sleeve portion 14 is inserted within the neck 20 of the bottle when the stopper 10 is installed and therefore has an outside diameter 22 that is less than the inside diameter 23 of such bottle necks 20. A number of thin sealing ridges 24 extend circumferentially around and laterally outwardly from the outer surface 26 of the sleeve portion 14. The ridges 24 each have an outside diameter 28 which is slightly greater than the inside diameter 23 of the bottle neck 20. Consequently, the ridges 24 are resiliently compressed when the sleeve portion 14 is inserted into the bottle neck 20, thereby forming an air-tight and fluid-tight seal between the sleeve portion 14 and the bottle neck 20.

The upper flange portion 16 extends laterally outward from the outer surface 26 of sleeve portion 14 and longitudinally upward from the upper end 30 of sleeve portion 14. The lower edge 32 of the upper flange 16 acts as an index, abutting the lip 34 of the bottle neck 20 when the sleeve portion 14 is properly positioned within the bottle neck 20. An axial bore 36 extends longitudinally through the upper flange portion 16 and the sleeve portion 14. The lower flange portion 18 extends laterally inward to an axial orifice 38, thereby partially closing bore 36. Preferably, the lower flange portion 18 is "oversized" and the orifice 38 has a tapered, conical-shape, forming a valve seat 40, as further described below.

A rigid, one-piece, integral, inner body 42 is disposed within the bore 36 of the outer body 12 and is preferably composed of a hard polymeric material. The inner body 42 includes a longitudinally extending, cylindrical sleeve portion 44 and an upper flange portion 46 which extends laterally outward from the outer surface 48 of sleeve portion 44 and longitudinally upward from the upper end 50 of sleeve portion 44. A stepped axial opening 52 extends longitudinally through the sleeve and upper flange portions 44, 46. The diameter 54 of the opening in the sleeve portion 44 is greater than the diameter 56 of the opening in the upper flange portion 46, such that the upper flange portion 46 forms a downward facing shoulder 58.

The sleeve portion 44 of the inner body 42 is disposed within the sleeve portion 14 of the outer body 12 and the upper flange portion 46 of the inner body 42 is disposed within the upper flange portion 16 of the outer body 12. Upper flange portion 46 has upper and lower segments 60, 62 where the outer diameter 64 of the lower segment 62 is larger than the outer diameter 66 of the upper segment 60. The lower segment 62 is received in a circumferential groove 68 on the inner surface of upper flange portion 16. Preferably, the outer diameter 64 of the lower segment 62 is greater than the inside diameter of the bottle neck 20 whereby the rigid material of upper flange portion 46 and the resilient material of upper flange portion 16 could not be inserted into the bottle neck 20.

A rigid, one-piece, integral, valve actuator 70 is disposed in the opening 52 of the inner body 42. The valve actuator 70 has an upper operator portion 72 connected to a lower valve body portion 74 by a longitudinally extending shaft portion 76. The operator portion 72 has a knob-shape to facilitate gripping by a user's hand. The outside diameter 78 of the operator portion 72 is greater than the diameter 56 of the opening 52 in the upper flange portion 46 of the inner body 42 such that operator portion 72 cannot be pushed or pulled through opening 52. The valve body portion 74 has a conical shape which is complementary to that of the orifice 38 in the lower flange portion 18 of the outer body 12 such that the seating surface 40 of the orifice 38 forms an air-tight and fluid-tight seal with the valve body portion 74 when the valve body portion 74 is urged into the orifice 38. The tapered shape increases the frictional force between the seating surface 40 and valve body portion 74, thereby providing improved resistance to air leakage into the bottle 20. A lower retainer segment 80 of the shaft portion 76 is disposed proximate to the valve body portion 74. The outside diameter 84 of the retainer segment 80 is smaller than the diameter 54 of the opening 52 in sleeve portion 44 but greater than the diameter 56 of the opening 52 in upper flange portion 46 such that the retainer segment 80 engages shoulder 58 to prevent complete withdrawal of the valve actuator 70 from the inner body.

The length 86 of the shaft portion 76 is selected to allow the valve body portion 74 to be fully withdrawn from orifice 38 before retainer segment 80 engages shoulder 58. When the valve body portion 74 is fully withdrawn from orifice 38, the "oversized" lower flange portion 18 protrudes upwardly into the opening 52 of sleeve portion 44. The length 86 of the shaft portion 76 is also selected to ensure that valve body portion 74 is fully inserted into and in sealing engagement with orifice 38 before operator portion 72 engages upper flange portion 46. When the valve actuator 70 is initially urged downward, the valve body portion 74 contacts the seating surface 40 of orifice 38. Preferably, the valve actuator 70 is inserted only a length 87 before valve body portion 74 engage seating surface 40 (FIG. 1). Continued downward movement of the valve actuator 70 causes the valve body portion 74 to bias lower flange portion 18 downward, out of opening 52. A circumferential indicator 88, or other indicia, on the shaft portion 76 is received within opening 52 when the valve body portion 74 is fully seated in orifice 38.

A separate pump 90 is used to withdraw the air from the bottle.

The pump comprises a pump housing 92 with cylindrical chamber 94 having a piston 96 disposed therein. A pipe-shaped piston rod 98 extends from the piston 96 to a handle 100. A check valve, such as a mushroom-shaped non-return valve (not shown), is mounted in an opening (not shown) in the piston 96. A dome-shaped receptacle portion 102 of the pump housing 92 has a lower lip 104 sized to receive and sealingly engage the upper flange portion 16 of the outer body 12.

The height of the receptacle portion 102 is selected such that the operator portion 72 of the valve actuator 70 does not engage the inner surface of the receptacle portion 102 when the valve body portion 74 is fully withdrawn from orifice 38 and lip 104 engages upper flange portion 16. A passageway 106 and openings 108, 110 in the receptacle wall and the lower portion of the chamber wall provide a flow path between the receptacle 102 and chamber 94.

When the piston rod 98 and piston 96 move upwards, the check valve prevents flow through the opening in the piston 96, thereby extracting air from the bottle via opening 108, passageway 106, and opening 110. When the piston 96 is subsequently moved downwards, the air passes through the opening in the piston 96 and exhausts through an opening 112 in the upper portion of the pump housing 92.

During the suction stroke of the pump 90, air inside the bottle pushes the valve actuator 70 upward, unseating valve body portion 74 from orifice 38. The air flows through the orifice 38 and out of the stopper 10 via the stepped opening 52 of the inner body 42. When the pumping action stops, the valve actuator 70 is drawn downward by the vacuum in the bottle, engaging the valve body portion 74 within orifice 38 and thereby sealing the air passage. The pressure differential across the valve actuator 70 will further urge the valve actuator 70 downward, thereby pushing the flexible lower flange portion 18 of the outer body 12 down towards the inside of the bottle. The indicator 88 adjacent the operator portion 72 of the valve actuator 70 is drawn into the opening 52 in the upper flange portion 46 of the inner body 42. To remove the bottle stopper 10, the vacuum is released by grasping operator portion 72 and pulling the valve actuator 70 upward, unseating the valve body portion 74 from orifice 38.

The vacuum in the bottle 20 acts on the bottom biasing surface 114 of the lower flange portion 18 of the outer body 12 in opposition to a resilience force of the lower flange portion 18, such that the indicator 88 is positioned within the opening 52 of the inner body 42 when the vacuum is greater than a predetermined value and the indicator 88 is visible above the upper flange portion 46 of the inner body 42 when the vacuum is less than the predetermined value, providing an indication that a sufficient vacuum has been drawn in the bottle. Should the seal between the valve body portion 74 and orifice 38 leak, the resilient force exerted by the lower flange portion 18 of the outer body 12 will draw the valve actuator 70 upward against the force of the remaining vacuum. When the vacuum drops below the predetermined value, the resilient force of the lower flange portion 18 will have sufficiently withdrawn the valve actuator 70 that indicator 88 will be visible above the upper flange portion 46 of the inner body 42.

Therefore, the subject bottle stopper 10 provides a visible indication of failure of the vacuum seal.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A stopper for use in the neck of a bottle, the bottle having a vacuum therein, the stopper comprising:

an outer body including a cylindrical sleeve portion and a resilient lower flange portion adapted for insertion into the bottle neck, the sleeve portion having an outer surface adapted for forming an air-tight and fluid-tight seal with the bottle neck and defining an axial bore having an interior surface, the lower flange portion extending radially inward from the interior surface to an axial orifice having a sealing surface, the lower flange portion having a bottom biasing surface adapted for being acted on by the vacuum in the bottle;

a valve actuator including an upper operator portion connected to a lower valve body portion by a longitudinally extending shaft portion, the shaft portion having an indicator disposed proximate to the operator portion, the lower valve body portion and at least a part of the shaft portion being disposed within the bore of the outer body, the valve body portion being sealingly engageable with the sealing surface of the orifice to close the orifice; and a substantially rigid inner body including a longitudinally extending sleeve portion disposed intermediate the sleeve portion of the outer body and the shaft portion of the valve actuator;

wherein the vacuum in the bottle acts on the biasing surface of the lower flange portion to bias the lower flange portion and the valve actuator downward into the bottle neck in opposition to a resilience force of the lower flange portion, whereby the indicator is withdrawn within the bore of the outer body when the vacuum is greater than a predetermined value and the indicator is visible above the outer body when the vacuum is less than the predetermined value.

2. The stopper of claim 1 wherein the sealing surface of the orifice and the valve body portion have complimentary conical shapes.

3. The stopper of claim 1 wherein the outer body also includes an upper flange portion extending radially outward from the outer surface of the sleeve portion of the outer body, the upper flange portion having a lower edge adapted for abutting a lip of the bottle neck when the stopper is installed.

4. The stopper of claim 3 wherein the upper flange portion of the outer body has an inner surface defining a circumferential groove and the inner body also includes a laterally extending upper flange portion having upper and lower segments, the lower segment being received in the circumferential groove of the upper flange portion of the outer body.

5. The stopper of claim 4 wherein the upper flange portion and sleeve portion of the inner body each define an axial opening having a diameter, the diameter of the opening in the sleeve portion of the inner body being greater than the diameter of the opening in the upper flange portion of the inner body, whereby the upper flange portion forms a downward facing shoulder.

6. The stopper of claim 5 wherein the operator portion of the valve actuator has an outside diameter which is greater than the diameter of the opening in the upper flange portion of the inner body and a knob-shape adapted for facilitating hand-gripping.

7. The stopper of claim 6 wherein the shaft portion of the valve actuator has a length selected to ensure that valve body portion of the valve actuator is fully sealing engaged with the orifice of the outer body before the operator portion of the valve actuator engages the upper flange portion of the inner body.

8. The stopper of claim 5 wherein the shaft portion of the valve actuator has a retainer segment disposed proximate to the valve body portion, the retainer segment having an outside diameter which is greater than the diameter of the opening in the upper flange portion of the inner body.

9. The stopper of claim 8 wherein the shaft portion of the valve actuator has a length selected to ensure that the valve body portion to be full withdrawn from orifice of the outer body before the retainer segment of the valve actuator engages the shoulder of the upper flange portion of the inner body.

10. The stopper of claim 9 wherein the lower flange portion of the outer body protrudes upwardly into the opening of sleeve portion of the inner body when the valve body portion of the valve actuator is fully withdrawn from the orifice of the outer body.

11. The stopper of claim 10 wherein the valve body portion of the valve actuator biases the lower flange portion of the outer body downward out of the opening of the sleeve portion of the inner body when the valve body portion of the valve actuator is fully sealing engaged with the orifice of the outer body.

12. A stopper for use in the neck of a bottle, the bottle having a vacuum therein, the stopper comprising:

a resilient outer body including a cylindrical sleeve portion disposed intermediate upper and lower flange portions, the sleeve portion and lower flange portion being adapted for insertion into the bottle neck, the sleeve portion and the upper flange portion defining an axial bore having an interior surface, the lower flange portion extending radially inward from the interior surface to an axial orifice having a sealing surface, the lower flange portion having a bottom biasing surface adapted for being acted on by the vacuum in bottle, the sleeve portion having an outer surface adapted for forming an air-tight and fluid-tight seat with the bottle neck;

a substantially rigid inner body including a sleeve portion extending longitudinally from an upper flange portion and defining a longitudinally extending opening, the upper flange portion of the inner body being disposed within the bore in the upper flange portion of the outer body, the sleeve portion of the inner body being disposed within the bore in the sleeve portion of the outer body; and a valve actuator including an upper operator portion connected to a lower valve body portion by a longitudinally extending shaft portion, the shaft portion having an indicator disposed proximate to the operator portion, the lower valve body portion and at least a part of the shaft portion being disposed within the opening of the inner body, the valve body portion being sealingly engageable with the sealing surface of the orifice to close the orifice;

wherein the vacuum in the bottle acts on the biasing surface of the lower flange portion of the outer body to bias the lower flange portion of the outer body and the valve actuator downward into the bottle neck in opposition to a resilience force, whereby the indicator is withdrawn within the opening of the inner body when the vacuum is greater than a predetermined value and the indicator is visible above the inner body when the vacuum is less than the predetermined value.

13. The stopper of claim 12 wherein the opening in the upper flange portion of the inner body forms a downward facing shoulder, the shaft portion of the valve actuator has a retainer segment disposed proximate to the valve body portion, and the shaft portion of the valve actuator has a length selected to ensure that valve body portion of the valve actuator is fully sealing engaged with the orifice of the outer body before the operator portion of the valve actuator engages the upper flange portion of the inner body and to ensure that the valve body portion is full withdrawn from orifice of the outer body before the retainer segment of the valve actuator engages the shoulder of the upper flange portion of the inner body.

* * * * *

UNITED STATES PATENT AND TRADEMARK OFFICE

CERTIFICATE OF CORRECTION

PATENT NO. : 6,651,834 B2
DATED : November 24, 2003
INVENTOR(S) : Wong

It is certified that error appears in the above-identified patent and that said Letters Patent is hereby corrected as shown below:

Column 8,
Line 14, delete “seat” and substitute therefor -- seal --.

Signed and Sealed this

Eleventh Day of January, 2005

JON W. DUDAS
*Director of the United States Patent and Trademark Office*